US006134894A

United States Patent [19]

Searle et al.

[11] Patent Number: 6,134,894

[45] **Date of Patent: *Oct. 24, 2000**

[54] METHOD OF MAKING BEVERAGE CONTAINER WITH HEATING OR COOLING INSERT

[76] Inventors: Matthew J. Searle, Westcombe Stables, Westcombe, Shepton Mallet, Somerset BA4 6ES; Carden H. Taft, 201 Vauxhall Bridge Road, London SW1V 1ER, both of United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/945,493

[22] PCT Filed: Mar. 22, 1996

[86] PCT No.: PCT/GB96/00692

§ 371 Date: Oct. 23, 1997

§ 102(e) Date: Oct. 23, 1997

[87] PCT Pub. No.: WO96/29255

PCT Pub. Date: Sep. 26, 1996

[30] Foreign Application Priority Data

Mar. 23, 1995 [GB] United Kingdom ..... 9505948
Mar. 27, 1995 [GB] United Kingdom ..... 9506194

[51] Int. Cl.[7] ..... F25D 3/08

[52] U.S. Cl. ..... 62/62; 62/293; 62/372; 123/263.01

[58] Field of Search ..... 62/4, 293, 372, 62/457.3, 457.4, 1, 62; 126/263.01, 263.05

[56] References Cited

U.S. PATENT DOCUMENTS

| | | | |
|---|---|---|---|
| 1,897,723 | 2/1933 | Free | 62/4 |
| 2,409,279 | 10/1946 | Hiller . | |
| 2,914,061 | 11/1959 | Del Raso | 126/262 |
| 3,369,369 | 2/1968 | Weiss | 62/4 |
| 3,970,068 | 7/1976 | Sato | 126/263 |
| 4,584,848 | 4/1986 | Barnett | 62/294 |
| 4,640,102 | 2/1987 | Tenebaum et al. | 62/294 |
| 4,656,838 | 4/1987 | Shen | 62/294 |
| 4,981,022 | 1/1991 | Snyder | 62/457.3 |
| 5,189,892 | 3/1993 | Roberts | 62/372 |
| 5,467,877 | 11/1995 | Smith | 62/457.3 |
| 5,502,981 | 4/1996 | Sullivan | 62/372 |

FOREIGN PATENT DOCUMENTS

| | | |
|---|---|---|
| 297 724 | 1/1989 | European Pat. Off. . |
| 791406 | 11/1935 | France . |
| 1491155 | 6/1967 | France . |
| 2 661 895 | 11/1991 | France . |
| 2 714 660 | 7/1995 | France . |
| 32 26 663 | 12/1983 | Germany . |
| 0 279 971 | 8/1988 | United Kingdom . |

*Primary Examiner*—William E. Tapolcai
*Attorney, Agent, or Firm*—Pillsbury Madison & Sutro LLP

[57] ABSTRACT

A container for a beverage has a conventional external configuration with a cylindrical wall closed by a top member. The base member closing the other end of the wall is shaped to form an external cavity which extends within the container along its longitudinal axis. The wall defining the external cavity has a surface in contact with the contents of the container and this surface has a large surface area. The contents of the container can be cooled, heated, or kept hot, or kept cold by the insertion of an insert into the external cavity. To ensure good heat transfer, the insert is push fitted into the external cavity. The insert may be heated or cooled before it is inserted, or it may be actuable to heat up or to cool down. The container is configured to be substantially the same size and shape externally as conventional containers, although it does have a smaller capacity. It can therefore be filled on the usual filling lines. Furthermore, the container can be filled and treated before any insert is retained therein. This enables treatments such as pasteurization to be carried out.

7 Claims, 2 Drawing Sheets

METHOD OF MAKING BEVERAGE CONTAINER WITH HEATING OR COOLING INSERT

Figure 1:
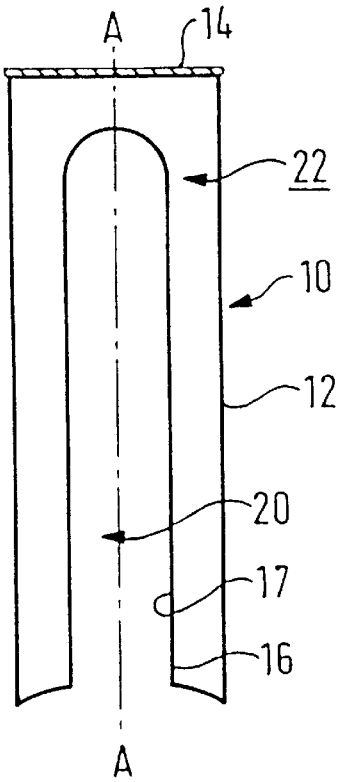

The present invention relates to containers.

There have been many proposals for self-heating or self-cooling containers. Generally, however, these proposals have required entirely new configurations of containers to be provided which cannot be used on existing filling lines. Such containers therefore require a heavy investment by beverage manufacturers. Other proposals require the heating or cooling means to be incorporated within the container before it is filled. This generally prevents pasteurising, sterilising, or other treatments being made on the contents of the container because of the risk of damaging or adversely affecting the heating or cooling means.

It is an object of the present invention to seek to reduce the disadvantages of prior proposals.

According to a first aspect of the present invention there is provided a container for a beverage having a tubular peripheral wall defining two spaced open ends, one open end being closed by a top member, and the other open end being closed by a base member, said peripheral wall and the top and base members defining an internal cavity for containing a beverage, wherein said base member is indented to define an external cavity which extends within said peripheral wall substantially along the longitudinal axis of said container, wherein said external cavity extends within the internal cavity, but is separated therefrom by said base member, and wherein said external cavity extends over a major part of the length of said longitudinal axis.

The external cavity may be provided in any conventional container without affecting the external configuration or size of the container, although it does reduce the capacity thereof. This means that a container of an embodiment of the invention can be filled on existing filling lines without difficulty. Furthermore, because of its longitudinal extent, the external cavity provides a large surface area in contact with the contents of the container for maximum heat transfer.

The present invention also extends to a container for a beverage having a tubular peripheral wall defining two spaced open ends, one open end being closed by a top member, and the other open end being closed by a base member, said peripheral wall and the top and base members defining an internal cavity for containing a beverage, wherein said base member is indented to define an external cavity which extends within said peripheral wall substantially along the longitudinal axis of said container, wherein said external cavity extends within the internal cavity, but is separated therefrom by said base member, and wherein an elongate insert is retained within said external cavity.

Preferably, the insert may be selected from a plurality of different inserts whereby one design of container may be arranged to be self-heating, or self-cooling, or cool retaining, or heat retaining, at the choice of the manufacturer, retailer or user in dependence upon the insert chosen.

In a preferred embodiment, the base member is formed from sheet material, preferably of a conductive material. In this respect, for good heat transfer it is important to retain good heat conductivity between the insert in the external cavity and the contents in the internal cavity of the container. Thus, the sheet material of the base member is generally metal, preferably aluminium.

In an embodiment, the sheet material of the base member is shaped to form a peripheral defining wall of said external cavity. It will be appreciated that one surface of said peripheral defining wall will be within the external cavity, and that the opposed surface of the peripheral defining wall will be within the internal cavity.

Preferably, at least said opposed surface of said peripheral defining wall has means to extend its surface area.

Such surface area extending means may be, for example, vanes or other configurations provided on said opposed surface. The use of an extended surface area aids in heat transfer.

The container, and its external cavity, may be of any appropriate shape, configuration and size. In a preferred embodiment, the tubular peripheral wall is substantially cylindrical defining, for example, a generally cylindrical container or can.

Preferably, the external cavity is substantially cylindrical with a domed, closed end.

The container may be made by any appropriate means. For example, the container may be manufactured in two parts. Presently, it is envisaged that the container will be manufactured in three parts, namely, the shaped base member, the peripheral wall, and the top member.

The container may be of any appropriate material, for example, of plastics material. However, as it is generally required that the peripheral defining wall of the external cavity be of metal or other conductive material, it is presently preferred that the rest of the container be made of the same material. The metal of the container may be, for example, aluminium.

It may be required to insulate the contents of the container and/or to protect users from the extreme heat or cold of the container. In this respect, the outer surface of the peripheral wall may be insulated in any required manner. For example, an outer wrapper of a plastics material may be provided on the exterior of the peripheral wall.

In an alternative embodiment the peripheral wall, at least, of the container may be made of a plastics material sufficiently thick to provide for heat insulation.

One or more elongate inserts may be provided for retention within the external cavity of the container.

It is preferred that a range of inserts be provided so that a range of containers with different functions may similarly be provided.

Generally, it is preferred that the insert is arranged to be retained by a push fit within the external cavity. Not only does this simplify the retention of the insert, but it also ensures good heat conducting contact between the insert and between the peripheral defining wall of the external cavity.

Preferably, the insert is shaped to have an external configuration which is substantially the same as the internal configuration of the external cavity. For example, each insert may be substantially cylindrical with a domed top and a planar base.

The insert may be arranged to keep the contents of a container cool. For example, the insert may comprise a freezable material. This material is preferably one which melts at less than 5° C., for example, water, heavy water or a freezable gel. It will be appreciated that if a frozen insert is inserted into the external cavity of a cooled container, the insert will act to absorb heat from the contents of the container, such heat tending to melt the frozen material of the insert. Such a frozen insert may be effective in keeping the container contents chilled for up to 8 hours.

Such a frozen insert may also be used to cool the contents of the container in the first instance, but such cooling may be rather slow.

If cooling of the contents is required, it is proposed that an insert be provided which is a cooling element. For example, the insert may be an electrically powered cooling element, or a cooling element relying upon chemical reactions. In one embodiment, the cooling element is a gas cylinder with controllable vent means for venting the gas to atmosphere when cooling thereof, and of the container contents, is required.

Alternatively, the insert may comprise a heating element. Such a heating element may be chemically powered or electrically powered, for example.

Where electrical power is required this may be provided by batteries incorporated within the insert. Additionally, and/or alternatively, the insert may be connectible to an external electrical source such as the mains, or to a car or other external battery.

Preferably, a bottom cap is provided to extend across the base of the external cavity when the insert is retained therein. Such a cap may act to deny accidental access to the insert, and to any control means provided thereon.

The present invention also extends to an elongate insert for receipt within an external cavity defined in a beverage container.

Figure 2:
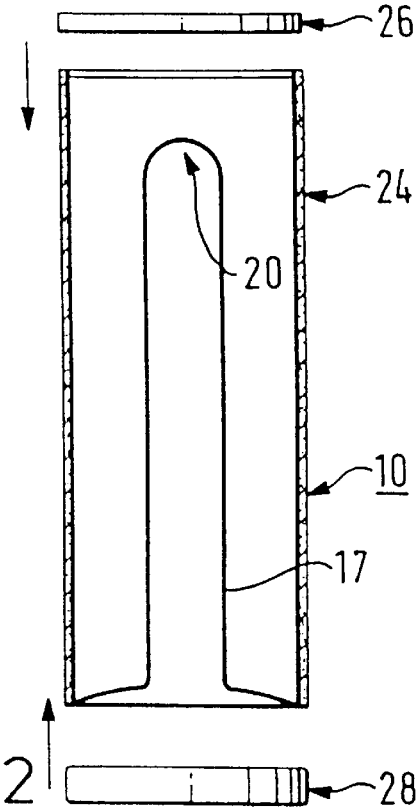
Figure 3:
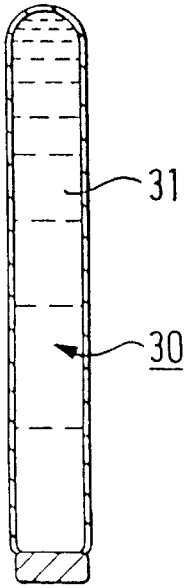
Figure 4:
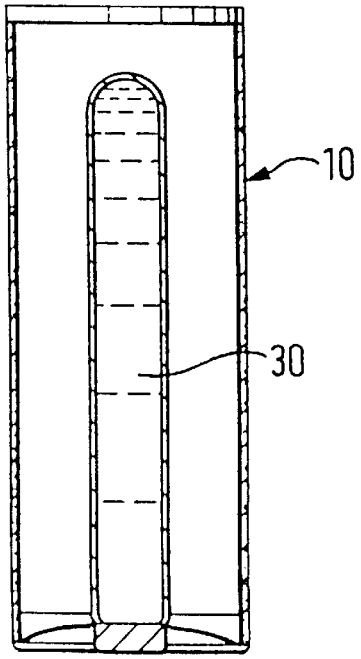
Figure 5:
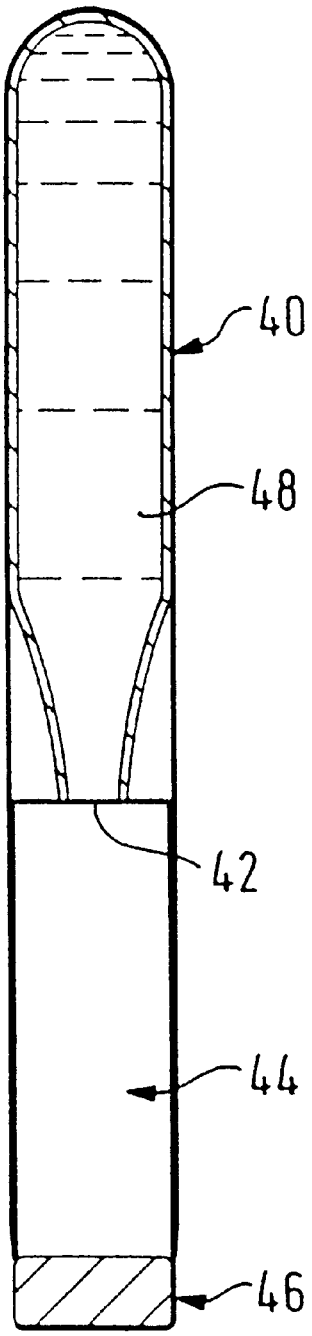
Figure 6:
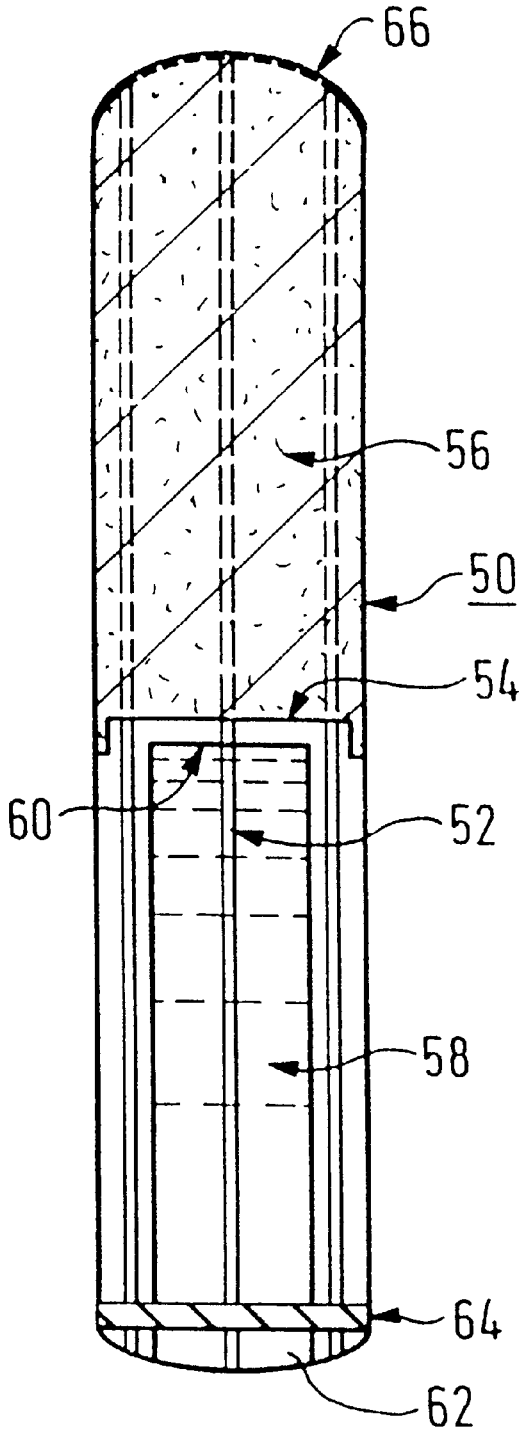

Embodiments of the present invention will hereinafter be described, by way of example, with reference to the accompanying drawings, in which:

FIG. 1 shows a cross section of a first embodiment of a beverage container of the present invention, FIG. 2 shows a second embodiment of a beverage container of the invention provided with insulation, FIG. 3 shows an elongate insert for use with the container of FIG. 2, FIG. 4 shows a cross section through the container of FIG. 2 with the insert and insulation in place, FIG. 5 shows one example of an insert for cooling a container, and FIG. 6 shows one example of an insert for heating a container.

The present invention relates to a container, such as a can, for beverages which may be self-cooling, or self-heating, or provided with means to keep the contents warm or cold. In this respect, it is generally required to chill, or keep cool, beverages such as beer, soft drinks and iced tea. It is generally required to heat, or keep warm, drinks such as tea, coffee, hot chocolate and soup. A container of the present invention can achieve all of these functions by simple choice of an appropriate insert.

FIG. 1 is a cross section through a container 10 of the present invention. This container 10 has a substantially cylindrical peripheral wall 12 which is closed at one open end by a top member 14. A conventional container as 10 would also have a generally planar base closing the other open end of the peripheral wall 12. However, and as can be seen in FIG. 1, the container 10 of the invention has a base member 16 formed from sheet material to define an elongate, external cavity 20 which extends within the peripheral wall 12 substantially along the longitudinal axis A—A of the container 10. It will be appreciated that the peripheral wall 12 and the top and base members 14 and 16 of the container together define an internal cavity 22 in which the beverage is received. It will be seen that the external cavity 20 extends within this internal cavity 22, but is separated therefrom by the peripheral defining wall 17 of the external cavity 20 which is formed by the base member 16.

The container 10 illustrated in FIG. 1 is configured to have the same external dimensions and shape as a conventional half liter beer can. However, the presence of the external cavity 20 reduces its capacity. The arrangement shown in FIG. 1 reduces the capacity of a half liter can to 0.33 liter. FIG. 2 illustrates an alternative configuration which reduces the capacity of a half liter can to 0.44 liter. However, each of the cans of FIGS. 1 and 2 has the same external dimensions as conventional cans, and therefore each can be used and filled on existing filling lines.

The external cavity 20 of the can 10 is to be utilised to enclose temperature changing means such as insert 30 (FIGS. 3 and 4) to effect heating or cooling of the can, or to keep the contents thereof warm or cool. To be effective, the external cavity 20 extends over a major part of the length of the longitudinal axis A—A of the can 10. This provides the peripheral defining wall 17 of the external cavity 20 with a large surface area within the can 10 to enhance heat conduction. If necessary, vanes or other surface area extending devices may be carried on the surface of the peripheral defining wall 17 which is within the internal cavity 22. Such surface extending means (not shown) enhance heat conduction between the internal and external cavities 20, 22 without interfering with the filling of the container on a conventional filling line.

As has been made clear above, a can 10, as shown in FIG. 1, may be used with a selected insert to obtain the effect required. The insert may be mounted in the can after it has been filled and sealed. This means that any treatments required on the can and its contents may be made without any adverse effects on the insert. For example, a filled can 10, as shown in FIG. 1, may be subjected to a pasteurization process or a sterilization process, or both, before the temperature changing insert 30 is inserted into the external cavity 20.

FIGS. 2 to 4 show an embodiment of a can 10 of the invention to be used to keep cold drinks cold. The can 10 shown in FIG. 2 is substantially identical to that of FIG. 1 except that the external cavity 20 is somewhat narrower. In addition, the can 10 of FIG. 2 has been covered with an insulating material sleeve 24, and a top cap 26 and a bottom cap 28 of an insulating material are provided. FIG. 3 shows an insert 30 which can be inserted into the external cavity 20 of the can 10 as shown in FIG. 2. The insert 30 is configured to be a push fit within the cavity 20 such that specific retention means will not generally be required. Furthermore, the external periphery of the insert 30 is substantially the same size and shape as the internal periphery of the external cavity 20 to ensure good heat conduction. Of course, and as is apparent from FIG. 4, the bottom insulating cap 28 cooperates with the can 10 and the insert 30 and may have a function of aiding the retention of the insert 30. Generally, however, the bottom insulating cap 28 is provided simply to keep the contents of the can cold and/or to act as a tamper proof seal.

The insert 30 of FIG. 3 is a metal cylinder, for example, filled with a material 31 which melts at a temperature of less than 5° C. The material 31 within the insert 30 may be water, heavy water, or a gel with a low melting temperature.

The can as shown in FIGS. 2 to 4 may be assembled by the user or by a retailer. Thus, the can 10 with its contents, but without its insert 30, is stored in a refrigerator, and the insert 30 is kept in a freezer until the material 31 therein is frozen solid. When it is required to use the can 10, it is removed from the refrigerator and the frozen insert 30 is inserted in its cavity 20. The insulating cap 28 is put in place. In this configuration, with all of the surfaces insulated, and the insert 30 in position, the contents of the can will keep cool for up to 8 hours. This means that the can 10 can be transported, or left without refrigeration, for this time and a chilled drink will still be available from it.

It would be possible to use a frozen insert 30, for example, as shown in FIG. 3, to chill the contents of a can 10, if required.

To work efficiently, good heat conduction is required between the insert 30 and the peripheral defining wall of the external cavity 20. Therefore, it is generally preferred that the defining wall 17 be of metal and that the wall of the insert 30 similarly be of metal. It may also be desirable to interpose a conductive gel between the insert 30 and the defining wall 17.

It is not essential that the insert 30 be contained by a peripheral wall although it is preferable. It would, for example, be possible to pack ice cubes with cold water into the external cavity 20. Of course, in this case a water tight seal would be required for the base of the external cavity 20.

Any insert material which has a low melting temperature and can absorb heat over an extended period may be used in place of the frozen water, frozen heavy water, or frozen gel to provide the cooling insert 30.

It is equally possible to keep the contents of a warmed can 10 warm by use of a heated insert. For example, an insert, as 30, filled with a heat retaining gel may be heated and then inserted into the external cavity 20 to keep the heated contents of the can warm.

FIG. 5 shows one embodiment of an insert 40 (temperature changing means) for cooling or chilling the contents of a can 10. The insert 40 is a cylinder having a gas chamber 48 containing carbon dioxide under pressure. The gas is pressurised to the extent that it is liquid. A valve (not shown) is provided to control an opening 42 of the gas chamber 48. When the valve is opened, the gas vents, and as it does so it evaporates and absorbs heat. Although carbon dioxide may be vented directly to atmosphere the insert 40 shown in FIG. 5 includes an expansion chamber 44 in which the vented gas may expand. In this manner, the flow rate of the gas as it exits through a port defined in a base structure 46 is reduced for safety.

The relative sizes of the gas chamber 48 and of the expansion chamber 44 may be chosen as required. The gas within the gas chamber 48 may be any gas which would be subjected to a change of phase at appropriate temperatures. Some gases may have to be flowed through a catalyst or chemicals before they are vented to atmosphere and such catalysts or chemicals may be provided within the chamber 44.

The self-cooling can incorporating an insert as 40 is preferably manufactured with the insert in place. The base structure 46 of the insert, which supports the vent valve, is received within a appropriate recess in the base member 16. A bottom cap, as 28, is preferably retained on the can to hide the base structure 46 from view and prevent accidental actuation. Preferably, destruction of the bottom cap 28 is required to give access to the base structure 46. The bottom cap 28 therefore provides an indication of tampering.

When it is required to dispense cooled contents from the can 10, it is turned upside down. The bottom cap 28 is removed, and the vent valve is actuated to vent the gas in the gas chamber 48 to atmosphere. The can is retained in this position for the few minutes necessary for all the gas to vent. Those few minutes enable the heat to be extracted from the can contents by the evaporating gas, whereby the can contents are chilled. The can may then be turned the correct way up and opened at the top to provide access to the contents in the usual manner.

Clearly, to chill the contents of a can using an insert as 40 requires that an insert capable of absorbing heat be inserted in the external cavity of the can. Any appropriate insert may be used. For example, an electrically powered insert, such as one utilizing the Peltier effect, may be provided. An electrically powered insert may include appropriate batteries or the insert may be connected to mains or external battery power.

FIG. 6 shows one embodiment of an insert 50 for heating the contents of a can 10. The illustrated insert 50 uses water and lime to provide an exothermic chemical reaction but any other constituents generating heat may be utilised.

The insert 50 shown in FIG. 6 comprises a generally cylindrical metal cylinder which has a plurality of spaced, longitudinally extending channels 52 along its outer surface. Thus, when the insert 50 is within the external cavity 20, the channels 52 extend between the insert 50 and the wall 17 of the cavity 20. Internally the length of the cylinder 50 is divided by a membrane 54 into two chambers 56, 58. The first of these chambers 56 contains lime, and the second of these chambers 58 contains water. Within the water chamber 58 there is also a membrane piercer 60 which is actuatable by a button 62 provided at the bottom of the insert 50. A tamper evident seal 64 may also be provided.

In use, the insert 50 is received within the external cavity 20 of a container 10 so that the button 62 is at the base of the can. Generally, and as shown in FIGS. 1 and 2, the base wall 16 of the can is shaped to provide a domed base and it is within this dome that the button 62 can be accommodated. In its normal state, the can 10 will have a base cap, as 28, which protects the button 62.

When it is required to heat the contents of the can, the can is stood on its top so that its base is accessible. Any base cap 28 is removed so that the button 62 is accessible. Depression of the button 62 causes the membrane 54 to be pierced by the membrane piercer 60 and hence water from the chamber 58 flows over the lime in chamber 56 causing the exothermic reaction. The steam which is generated exits through a membrane covered vent 66 provided on the top dome of the insert 50 and the steam is discharged from the container by way of the channels 52. The user will retain the can on its top until the exit of steam has been completed. At this stage, the contents of the can will have been heated to a satisfactory temperature. For example, it can take less than two minutes to heat the contents of the can to 70° C. At this juncture, the can is turned the correct way up, and the contents of the can can be dispensed in the normal way.

Clearly, to heat the contents of a can using an insert as 50 requires that an insert capable of generating heat be inserted into the external cavity of the can. Any appropriate insert may be used. For example, any appropriate chemical reaction may be utilised to provide the heating. If required, the heating may be electrically powered, and the insert may include batteries or be connected to mains or external battery power.

Only a number of the possible embodiments of the present invention have been described and illustrated above. In this respect, it will be appreciated that the construction of the can and the construction of the insert can be chosen as required to meet the circumstances. Variations and modifications may be made to the embodiments disclosed and illustrated within the scope of the accompanying claims.

What is claimed is:

1. A method for producing a temperature changeable beverage container, comprising:

producing a hollow beverage container having a top end and spaced therefrom a closed bottom end which is indented to from an external cavity extending toward said top end, filling said hollow container with a beverage, sealing said container by sealing said top end of said container with the beverage inside said container, treating the beverage in the sealed container, and then, inserting into said external cavity temperature changing means for changing the temperature of the beverage which is inside said container.

2. A method for producing a temperature changeable beverage container starting from a hollow container which has a top end and spaced therefrom a closed bottom end which is indented to form an external cavity extending toward said top end, said method comprising:

filling said hollow container with a beverage, sealing said container by sealing said top end of said container with the beverage inside said container, treating the beverage in the sealed container, and then, inserting into said external cavity temperature changing means for changing the temperature of the beverage which is inside said container.

3. A method for producing a temperature changeable beverage container starting from a hollow container which is filled with a beverage between a sealed top end and a spaced closed bottom end which is indented to form an external cavity extending toward said top end, said method comprising:

treating the beverage in the sealed container, and then, inserting into said external cavity temperature changing means for changing the temperature of the beverage which is inside said container.

4. A method as in claim 1, 2 or 3, wherein said treating the beverage in said sealed container includes subjecting said beverage to a pasteurization process.

5. A method as in claim 1, 2 or 3 wherein said treating the beverage in said sealed container includes subjecting said beverage to a sterilizing process.

6. A method as in claim 1, 2 or 3 wherein said temperature changing means includes an insert containing a plurality of separated different elements which when combined chemically react to cause a temperature change in said beverage, said method including:

combining said different elements for causing said chemical reaction to change the temperature of said beverage.

7. A method as in claim 1 or 2 wherein said filling said hollow container includes filling said hollow container on a filling line.

* * * * *